United States Patent [19]

Erck

[11] 4,275,472

[45] Jun. 30, 1981

[54] RECLINER

[76] Inventor: Edwin E. Erck, P.O. Box 1065, Camp Verde, Ariz. 86322

[21] Appl. No.: 88,606

[22] Filed: Oct. 26, 1979

[51] Int. Cl.[3] ..... A61G 7/10

[52] U.S. Cl. ..... 5/60; 5/111; 5/436; 5/443; 5/446; 5/431; 269/328

[58] Field of Search ..... 5/60, 68, 66, 81 R, 5/110–114, 431, 443, 436, 441, 446; 297/217, 284, 391, 464, 466, 468, 423, 431, 438; 128/33; 269/328

[56] References Cited

U.S. PATENT DOCUMENTS

| | | | |
|---|---|---|---|
| 2,785,418 | 3/1957 | Goguen | 5/443 |
| 3,781,928 | 1/1974 | Swallert | 5/68 |
| 3,795,018 | 3/1974 | Broaded | 5/68 |
| 3,813,091 | 5/1974 | Metzger | 5/443 |
| 3,987,504 | 10/1976 | Fox | 5/111 |
| 4,128,272 | 12/1978 | Boyler | 5/434 |
| 4,188,677 | 2/1980 | Zur | 5/68 |

*Primary Examiner*—Casmir A. Nunberg
*Attorney, Agent, or Firm*—Cahill, Sutton & Thomas

[57] ABSTRACT

A unitary recliner having segregated head, mid-section and foot rest supports a person in a reclining position without imposing any supporting pressure on the persons vertabrae. The three rests are contoured commensurate with the supported body parts to retain inadvertent lateral or longitudinal movement of the person which movement might cause the person to fall off one or another of the rests.

8 Claims, 5 Drawing Figures

RECLINER

The present invention relates to recliners and, more particularly, to recliners having segregated body supporting members.

Over the years, various cots and recliners have been developed which incorporate moveably attached supports for a person's upper section, mid-section and lower section. The following U.S. Letters Patent are representative of various such prior art developments. U.S. Pat. No. 2,374,488 describes a surgical cot having a vertically pivotable head rest and vertically and laterally pivotable leg rests. U.S. Pat. No. 2,843,181 discloses an inflatable device having two end sections pivotally positionable with respect to a mid-section and configurable as a cot or as a chair having a back. U.S. Pat. No. 3,211,495 is directed to a recliner having a plurality of pivotally attached sections, each of which is positionable at various angles. U.S. Pat. No. 3,561,772 is directed to an exercise device having pivotally attached supporting surfaces conformable to various body movements. U.S. Pat. No. 3,781,928 shows a bed having raisable head and foot ends. U.S. Pat. No. 3,978,530 shows a supporting surface for a reclining person, which surface may be reconfigured by repositioning various underlying supporting rollers. U.S. Pat. No. 4,083,068 describes a positionable recliner having a flexible center section and planar end sections pivotable with respect to the center section. U.S. Pat. No. 3,795,018 illustrates a bed having raisable segments.

For comfort or for health reasons, various body position maintaining devices have been developed for maintaining a specified body section at a fixed position upon a supporting surface. U.S. Pat. No. 3,234,623 describes a contoured block useable to locate various body parts with respect to a supporting surface. U.S. Pat. No. 3,946,451 illustrates a limb support having a channel disposed in a block for supporting a limb in a predetermined orientation. U.S. Pat. No. 3,949,437 is directed to a head rest useable in conjunction with a bed or other surface for supporting a person in a reclining position. U.S. Pat. No. 3,981,032 describes a neck and head rest having vibrators incorporated therein to relax a user. U.S. Pat. No. 4,128,272 describes a combination of segragable cushions for supporting a person in a semi-reclining position.

All of the above-described recliners and beds provide at least a modicum of support for the user's back. Such support may cause great discomfort and at least some pain to one who has injured his back. To avoid such discomfort or pain, it is mandatory that the vertabrae not be subjected to any pressure by an underlying supporting surface. None of the above described beds or recliners or any other devices known to applicant are capable of supporting a person without the application of pressure to the person's vertabrae. While the body positioning elements disclosed in the above identified patents may be of some aid to maintain a person's body in the least painful position, they are not effective in removing all discomfort or pain.

It is therefore a primary object of the present invention to provide a recliner which does not bear upon a user's back.

Another object of the present invention is to provide a recliner which does not apply any pressure to the user's vertabrae.

Yet another object of the present invention is to provide a recliner having three supporting surfaces for supporting the user's head, mid-section and feet.

Still another object of the present invention is to provide a segmented recliner which maintains a person's body located thereupon.

A further object of the present invention is to provide a segmented recliner having positionable segments to maintain a person in any one of several selectable positions.

A yet further object of the present invention is to provide a means for automatically varying the angular relationships between the body supporting segments of a segmented recliner.

A still further object of the present invention is to provide a light-weight segmented recliner.

These and other objects of the present invention will become apparent to those skilled in the art as the description thereof proceeds.

The present invention may be described with greater specificity and clarity with reference to the following drawings, in which.

Figure 3:
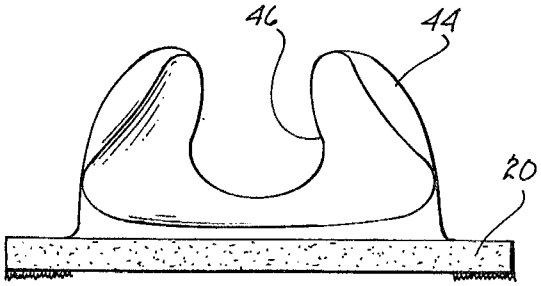
FIG. 3 is an end view taken along lines 3—3, as shown in FIG. 2.
Figure 1:
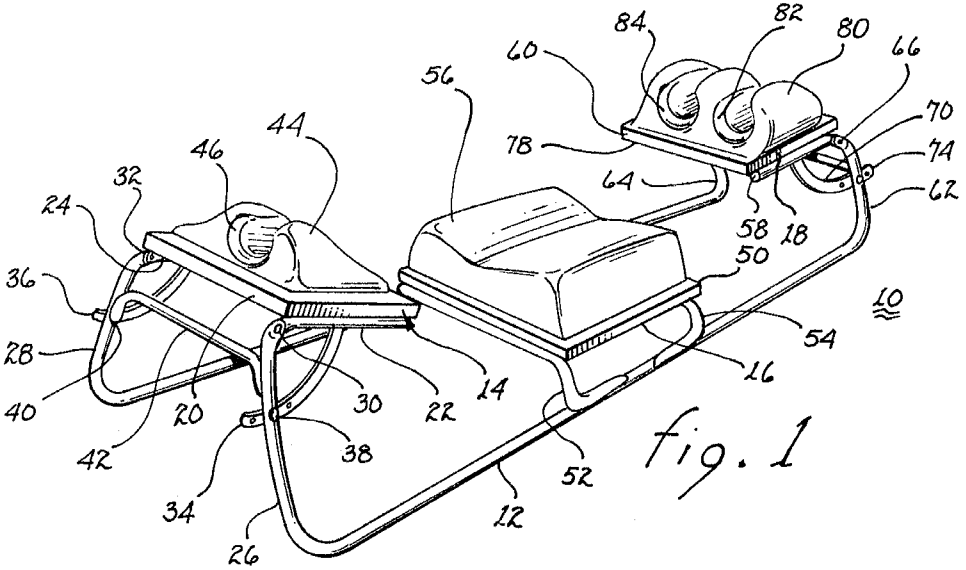
FIG. 1 is a perspective view of a segmented recliner.

Referring to FIG. 1, there is shown a recliner 10 having a tubular frame 12. The tubular frame supports a head section 14, a mid-section 16 and a foot section 18. As may be deduced from FIG. 1, a person reclining upon recliner 10 has support for his head, mid-section or hips and his feet and there exists no support adjacent his back. Accordingly, there will exist no pressure upon his vertebrae, which pressure might cause discomfort or pain.

Referring jointly to FIGS. 2, 3, 4 and 5, various details of recliner 10 will be reviewed. Head section 14 includes a planar member 20 attached to and extending between tubing 22 and 24, which tubing is pivotally attached to arms 26 and 28 of tubular frame 12 at hinge points 30, 32. Arcuate braces 34 and 36 extend from planar member 20 and are detachably attached therealong to the respective ones of arms 26, 28 by engagement means, such as nut and bolt means 38 and 40. A cross piece 42 may be employed to stabilize the arms. A contoured cushion 44, which may be of resilient material or inflatable, is mounted upon planar member 20 to provide comfortable support for a user's neck, head, or upper shoulders. The contour of the cushion may be configured with a depression or receptacle 46 for receiving and retaining the user's neck and/or head. Attachment means 48, such as hook and loop elements sold under the trademark "Velcro" may be used, to removably retain the cushion on the planar member.

Mid-section 16 includes a planar member 50 supported upon legs 52 and 54 extending from opposed sides of tubular frame 12. A contoured cushion 56 is attached to planar member 50 by means such as attachment means 48. The cushion may include a top surface 51 sloping downwardly inwardly from the sides to discourage lateral displacement of a user's mid-section.

Foot section 18 includes a planar member 78 supporting a contoured cushion 80. Attachment means 48 may be employed to removably attach the cushion to the planar member. The planar member is attached to and extends between tubing 58 and 60, which tubing is pivotally attached to arms 62 and 64 at hinge point 66 and 68. Arcuate braces 70 and 72 extend from planar member 78 and are detachably attached therealong to the respective ones of arms 62, 64 by engagement means, such as nut and bolt means 74, 76. A cross piece 77 may be employed to stabilize the arms.

As illustrated, cushion 80 may include a pair of depressions or receptacles 82, 84 for receiving and partially encircling portions of the user's legs or feet. The resulting position maintaining characteristic of the cushion tends to preclude displacement of the user's legs off the cushion during inadvertent movement of the user while he sleeps.

Figure 2:
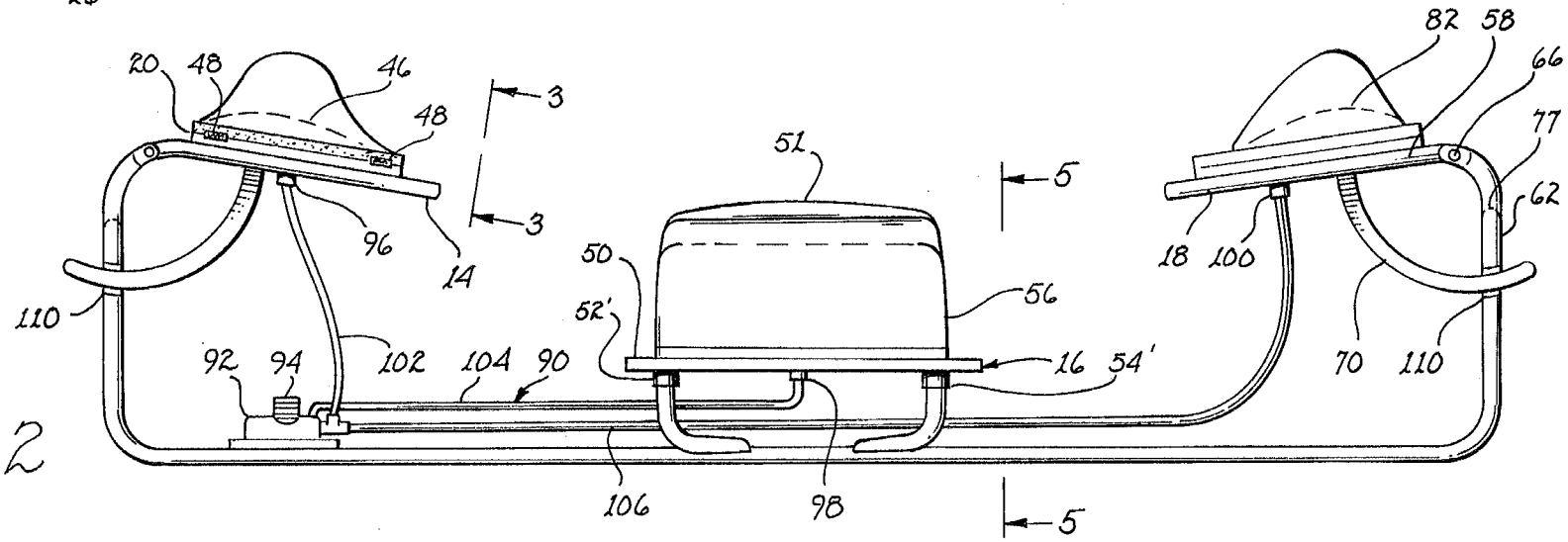
FIG. 2 is a side view of the segmented recliner.
Figure 4:
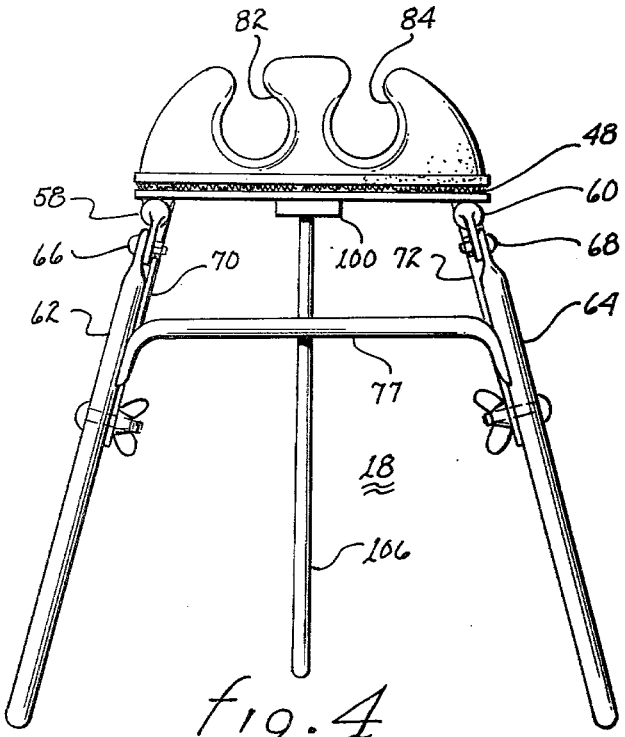
FIG. 4 is an end view of the foot of the segmented recliner.
Figure 5:
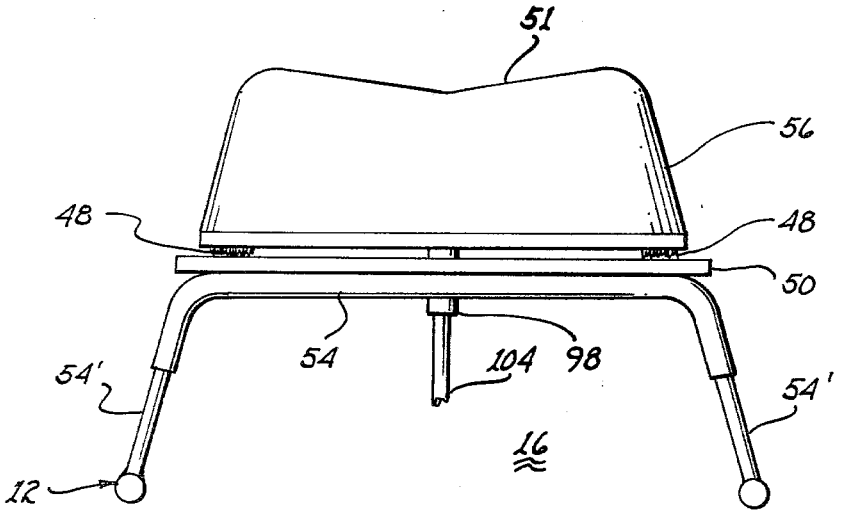
FIG. 5 is an end view taken along lines 5—5, as shown in FIG. 2.

As particularly illustrated in FIG. 2, the positional relationship of each of head section 14, mid-section 16 and foot section 18 may be varied by automated or power means, such as a pneumatic system 90. The pneumatic system includes a source 92 of air under pressure. A selectable switch 94 is actuatable to convey air under pressure to air cylinder 96 associated with headrest 14, air cylinder 98 associated with mid section 16 and/or air cylinder 100 associated with foot section 18. These cylinders are in fluid communication with source 92 through air lines 102, 104 and 106, respectively.

Through operation of switch 94, the air pressure may be increased or relieved within each of the air lines, which change in pressure would have the resulting effect of angularly reorienting the head and foot section and raising or lowering the mid-section. As will become evident by inspection, the braces attendant head section 14 and foot section 16 would have to be slidably attached to the respective arms of tubular frame 12 rather than being locked in place, as discussed above. Such sliding movement could be readily accommodated by guides 110 mounted upon the respective arms of the tubular framework. Necessarily, sleeved legs 52', 54' to accommodate vertical displacement of the mid-section. Alternatively, a mechanism could be provided to provide both vertical and pivotal movement to the mid-section. It is also to be understood that the power means could include a hydraulic system, a mechanical system or an electric system.

From the above description, it becomes apparent that the described recliner will adequately and completely support a user without applying any pressure to the user's vertabrae. Moreover, the sections of the recliner are readily adjustable to accommodate various head-high, foot-high or level body positions for the user for purposes of his comfort or for therapeutic reasons. By employing a pneumatic system, one or more of the sections may be readily angularly adjusted or vertically displaced by the user while the recliner is in use.

To provide ease of mobility, the tubular frame may be manufactured of lightweight aluminum tubing and the cushions, whether removable or not may be of lightweight foam.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A recliner for supporting only discrete body sections of a user, said recliner comprising in combination:

(a) a framework;

(b) a head section mounted upon said framework for supporting the neck of the user, said head section including a cushion;

(c) a mid-section mounted upon said framework for supporting the hips of the user, said mid-section being located distinct and laterally apart from said head section to preclude support for a user's back intermediate his supported neck and hips, said mid-section including a cushion;

(d) a foot section mounted upon said framework for supporting the lower legs of the user, said foot section being located distinct and laterally apart from said mid-section to preclude support for a user's legs intermediate his supported hips and lower legs, said foot section including a cushion;

(e) first means for varying the angular orientation of said head section with respect to said framework; and (f) second means for varying the angular orientation of said foot section with respect to said framework.

2. The recliner as set forth in claim 1 including means for varying the height of said mid-section with respect to said framework.

3. The recliner as set forth in claim 1 wherein said first and second varying means include power means for effecting angular reorientation of said head section and said foot section.

4. The recliner as set forth in claim 1 wherein said head section cushion is contoured and includes a receptacle extending thereacross for receiving the user's neck.

5. The recliner as set forth in claim 4 wherein said foot section cushion is contoured and includes a pair of receptacles extending thereacross for receiving the user's lower legs.

6. The recliner as set forth in claim 5 wherein said mid-section cushion is contoured and includes a centrally depressed surface for receiving the user's hips retaining them in place on the cushion.

7. The recliner as set forth in claim 1 wherein said head section, said mid-section and said foot section are pedestal supported upon upwardly extending arms, legs and arms, respectively, of said framework.

8. The recliner as set forth in claim 7 including means for varying the height of said mid-section with respect to said framework.

* * * * *